US005139094A

United States Patent [19]

Prevedel et al.

[11] Patent Number: 5,139,094

[45] Date of Patent: Aug. 18, 1992

[54] DIRECTIONAL DRILLING METHODS AND APPARATUS

[75] Inventors: Bernhard Prevedel, Stafford; Warren E. Askew; Alan Eddison, both of Houston, all of Tex.

[73] Assignee: Anadrill, Inc., Sugar Land, Tex.

[21] Appl. No.: 648,956

[22] Filed: Feb. 1, 1991

[51] Int. Cl.[5] ..... E21B 7/04; E21B 7/08

[52] U.S. Cl. ..... 175/61; 175/73; 175/107

[58] Field of Search ..... 175/45, 61, 76, 325

[56] References Cited

U.S. PATENT DOCUMENTS 2,194,267 3/1940 Brock et al. .
2,646,253 7/1953 Johnston .
2,805,840 9/1957 Thompson .
2,876,992 3/1959 Lindsay .
3,068,946 12/1962 Frisby et al. .
3,190,374 6/1965 Caperan et al. .
3,196,959 7/1965 Kammerer .
3,398,804 8/1968 Holbert .
3,457,999 7/1969 Massey .
3,561,549 2/1971 Garrison .
3,563,323 2/1971 Edgecombe .
3,586,116 6/1971 Tiraspolsky et al. .
3,667,556 6/1972 Henderson .
3,880,246 4/1975 Farris .
3,938,853 2/1976 Jurgens et al. .
4,015,673 4/1977 Craig, Jr. et al. .
4,067,404 1/1978 Crase .
4,076,084 2/1978 Tighe ..... 175/61 X
4,077,657 3/1978 Trzeciak .
4,220,214 9/1980 Benoit .
4,286,676 9/1981 Nguyen et al. .
4,394,881 7/1983 Shirley .
4,416,339 11/1983 Baker et al. .
4,442,908 4/1984 Steenbock .
4,445,578 5/1984 Millheim .
4,471,843 9/1984 Jones, Jr. et al. .
4,492,276 1/1985 Kamp .
4,508,182 4/1985 Anders .
4,522,272 6/1985 Beimgraben .
4,560,013 12/1985 Beimgraben .
4,577,701 3/1986 Dellinger et al. ..... 175/61
4,596,293 6/1986 Wallussek et al. ..... 175/45 X
4,596,294 6/1986 Russell .
4,597,454 7/1986 Schoeffler .
4,629,012 12/1986 Schuh .
4,635,736 1/1987 Shirley .
4,653,598 3/1987 Schuh et al. .
4,655,289 4/1987 Schoeffler .
4,655,299 4/1987 Schoeffler .
4,667,751 5/1987 Geczy et al. .
4,697,651 10/1987 Dellinger ..... 175/61
4,729,438 3/1988 Walker et al. .
4,739,842 4/1988 Krueger et al. .
4,745,982 5/1988 Wenzel .
4,807,708 2/1989 Forrest et al. .
4,811,798 3/1989 Falgout Sr. et al. .
4,813,497 3/1989 Wenzel .
4,817,740 4/1989 Beimgraben .
4,834,196 5/1989 Falgout, Sr. .
4,836,303 6/1989 Boulet et al. .
4,842,082 6/1989 Springer .
4,848,490 7/1989 Anderson ..... 175/325 X
4,854,397 8/1989 Warren et al. .
4,854,403 8/1989 Ostertag et al. .
4,858,705 8/1989 Thiery .
4,877,092 10/1989 Helm et al. .
4,880,066 11/1989 Steiginga et al. .
4,880,067 11/1989 Jelsma .
4,895,214 1/1990 Schoeffler .
4,932,482 6/1990 DeLucia .
5,022,471 6/1991 Maurer et al. .

OTHER PUBLICATIONS

P. N. Jogi et al., "Three-Dimensional Bottomhole Assembly Model Improves Directional Drilling", IADC/SPE Paper No. 14768, Feb. 10-12, 1986, Dallas, Tex.

Boulet, J. G., "THD System/Telepilote/Varistab", SMF International Article, Ocean Industry/OTC 1986.

"Mechanical Telepilote—The New Tool to Stay on Target", SMF International (no date).

12 ¼" Varistab Instruction Manual (1989).

H. Karlsson et al., "Performance Drilling Optimization", SPE Paper No. 13474, Mar. 6-8, 1985, New Orleans, La.

G. F. Pruitt et al., "Drilling with Steerable Motors in Large Diameter Holes", *SPE Paper No.* 17190, Eastman Christensen, Feb. 28-Mar. 2, 1988, Dallas, Tex.

S. L. Barrett et al., "The Navigation Drilling System Proves Effective in Drilling Horizontal Wells in the Java Sea", SPE Paper No. 17238, Feb. 28–Mar. 2, 1988, Dallas, Tex.
"Horizontal Systems Growing More Specialized", Directional Control Technologies, Offshore, pp. 36–43, Oct. 1989.
R. Newton et al., "A Case Study Comparison of Wells Drilled With and Without MWD Directional Surveys on the Claymore Platform in the North Sea", SPE Paper No. 9224, Sep. 21-24, 1980, Dallas, Tex.
W. B. Bradley, "Factors Affecting the Control of Borehole Angle in Straight and Directional Wells", SPE Paper No. 5070, Oct. 6-9, 1974, Houston, Tex.
L. J. Durand et al., "Kicking Off in Large-Diameter Holes", SPE Paper No. 9649, Mar. 9-12, 1981, Manama, Bahrain.
T. Brassfield et al., "Drill Faster, More Accurately with New Navigation System", World Oil, pp. 38–40, Aug. 1, 1985.
D. Nordquist et al., "Steerable System Cuts Straight Hole Drilling Costs 50%", Petroleum Engineer International, pp. 48-51, May 1988.

*Primary Examiner*—Ramon S. Britts
*Assistant Examiner*—Frank S. Tsay
*Attorney, Agent, or Firm*—David L. Moseley; John J. Ryberg

[57] ABSTRACT

Methods are provided for controlling the direction of a borehole drilled by a downhole motor, including the steps of positioning downhole adjustable bent housing and near-bit stabilizer in the drill string, adjusting the bent housing from its normally straight condition to its bent condition to effect borehole curvature, and using the stabilizer in its undergage condition to enhance the inclination. The Measurements are made from which the inclination with respect to the vertical and the azimuth can be determined and telemetered uphole for processing, display, and recording. Preferably the directional measurements are made at two locations, one below the bent point and one above it. These two sets of measurements can be compared to confirm the bend angle and to obtain a definition of the orientation of the plane of the bend angle so that the drilling path can be accurately controlled. Use of the present invention eliminates having to superimpose rotation of the deflected drill string in order to drill straight ahead because the bend angle can be eliminated by downhole adjustment.

34 Claims, 2 Drawing Sheets

DIRECTIONAL DRILLING METHODS AND APPARATUS

FIELD OF THE INVENTION

This invention relates generally to methods and apparatus combinations for controlling the direction of the drilling of a borehole, and particularly to the use of downhole adjustable tools and directional measurements to provide accurate control over the path or trajectory that a drill bit takes in a directional drilled well bore.

BACKGROUND OF THE INVENTION

In early drilling practice wells were drilled as near to the vertical as possible. Later it became common to drill directional or slanted wells to gain access to hydrocarbon deposits located underneath ground sites where it was not feasible to set up a drilling rig. As oil and gas exploration and production moved into offshore areas, it became conventional in view of economic considerations to drill a large number of directional boreholes from a single platform. Each well extends downward for a certain distance and then is kicked out on an inclined path that eventually reaches a target in the production zone. A downhole motor that operates in response to circulation of drilling fluid down the drill string is commonly used to rotate the bit in sections of the borehole where a change in direction is made. More recently, wells are being drilled that have a lower portion which extends horizontally in order to intersect a series of oil or gas bearing vertical fractures and thereby increase dramatically the production from a single well. In each circumstance where a directional borehole is to be drilled, there is a pressing need for precise and continuous control over the direction in which the borehole is to proceed so that a specified underground target can be reached as quickly and economically as possible. As used herein, the term "direction" means inclination with respect to the vertical, and the azimuth of such inclination.

Prior systems for controlling the direction of a borehole that is drilled using a downhole motor have employed either a rigid bent sub or bent housing to provide a permanent bend angle in the drill string above the bit, or a surface adjustable bent sub or housing which requires a round trip of the drill string in order to produce, change, or eliminate the bend angle. Such systems also have included undersized stabilizers, one located near the bit and another on top of the motor, to achieve a change in the trajectory of the borehole in a "sliding" mode, that is, where the drill string is not rotated but merely slides down the hole as the bit chips away at the rock. It also is known to superimpose drill string rotation at the surface along with downhole bit rotation from the motor with the aim of causing the bit to drill straight ahead. During rotation of the pipe, the bend point orbits about the longitudinal axis of the borehole, and although the bit wobbles slightly in this mode its overall tendency is to drill straight ahead in the same direction.

However, such prior systems have suffered from a number of significant problems. Rotation of a permanently bent or deflected motor housing can create excessive surface torque and cause cyclic bending stresses in the housing which can cause serious damage. The use of undersize stabilizers near the bit and above the motor, a requirement in sliding drilling wherein the pipe is not being rotated, frequently results in a drop in the inclination of the borehole when the pipe is rotated beyond that which is to be expected for a particular bottom hole assembly. Another problem with prior assemblies is that excessive drill string vibrations are generated by rotation of a bent bottom hole assembly that significantly reduce the useful lives to be expected of the downhole components, and which is believed to trigger certain borehole instability problems such as sloughing walls that can cause sticking of the downhole assembly.

Optimum directional control requires surface availability, substantially in real time, of certain information about the bottom section of the borehole such as its inclination, azimuth and the tool face angle. Within the past decade, apparatus and techniques have been developed for continuously measuring, while drilling, various characteristic properties of the earth formations intersected by a well bore, as well as other downhole parameters, and for telemetering the results of the measurements to the surface. Some of the parameters that can be measured and transmitted to the surface are components of the earth's gravity and magnetic fields from which the inclination with respect to vertical, azimuth with respect to magnetic North, and tool face angle can be computed, displayed, and recorded. The inclination and azimuth values can be plotted at regular depth intervals to enable a record to be made of the exact path taken by the borehole. These measurements also provide the basis for altering the path if it is not proceeding according to plan. However, the downhole means by which path corrections have been made have left much to be desired, and for one thing necessitated removing the drill string to temporarily place a special bent sub therein, or to rearrange the spacing of stabilizers.

An object of the present invention is to provide new and improved methods and apparatus combinations for use in controlling the direction of a borehole.

Another object of the present invention is to provide new and improved methods of directional drilling control that include adjusting downhole a mechanism that establishes a bend angle in the drill string to cause a change in direction.

Another object of the present invention is to provide a new and improved directional drilling control system where information relating to the orientation with respect to vertical or to North of a plane containing the axes of the bend angle below the bend point is transmitted to the surface substantially in real time.

Another object of the present invention is to provide a new and improved directional control system including bend angle and stabilizer mechanisms that can be adjusted downhole to permit more precise control over the trajectory of the bit.

SUMMARY OF THE INVENTION

These and other objects are attained in accordance with the concepts of the present invention through the provision of methods for controlling the direction of a borehole being drilled by a bit that is driven by a downhole motor, including the steps of positioning downhole adjustable bent housing and near-bit stabilizing mechanisms in the drilling string, adjusting the bent housing mechanism from its normally straight condition to its bent condition to effect borehole curvature, and using the stabilizer in its undergage condition to enhance the drilling of a curve. The plane of the bend angle is then oriented in the borehole with respect to vertical or to North so that the bit seeks to drill in a desired direction. Measurements are made from which the inclination with respect to the vertical and the azimuth can be determined, and such measurements are telemetered uphole for processing, display, and recording. Preferably the directional measurements are made at two locations, one below the bend point and one above it. These two sets of measurements can be compared to confirm the bend angle and to obtain a definition of the orientation of the plane of the bend in the borehole so that the path that will be taken by the bit in subsequent drilling can be accurately controlled. Use of the present invention eliminates having to superimpose rotation of the deflected drill string in order to drill straight ahead because the bend angle can be eliminated by downhole adjustment. Thus the stress and vibration problems that have been encountered in prior practices are substantially reduced, as well as unwanted drop in hole inclination.

BRIEF DESCRIPTION OF THE PREFERRED EMBODIMENTS

The present invention has other objects, features, and advantages which will become more clearly apparent in connection with the following description of preferred embodiments, taken in connection with the appended drawings in which.

BRIEF DESCRIPTION OF THE PREFERRED EMBODIMENTS

Figure 1:
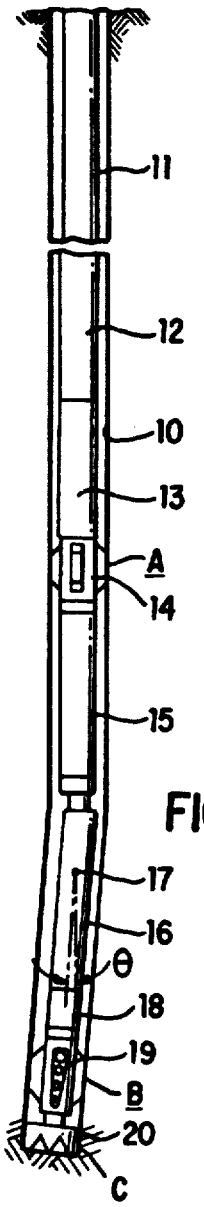
FIG. 1 is a schematic of a well bore having the apparatus components by which the present invention can be practiced disposed therein.

FIG. 1 shows a well bore 10 having a drill string including a length of drill pipe 11 and a length of drill collars 12 disposed therein. Connected to the lower end of the collars 12 is a measuring-while-drilling system 13 that measures certain characteristic properties of the earth formations intersected by the borehole 10, such as back-scattered gamma radiation and the electrical resistivities of the various rock strata, as well as measuring directional values such as inclination and azimuth of the borehole. An adjustable stabilizer 14 is connected between the system 13 and a drilling motor assembly 15 that is powered by mud circulation. The stabilizer 14 can be any suitable device such as the mechanism disclosed in U.S. Pat. No. 4,848,490 issued to Charles A. Anderson, which is incorporated herein by reference, or that mechanism to be described herein with respect to FIGS. 7–10. The lower portion of the housing of the motor 15 incorporates an adjustable bent mechanism 16. The mechanism 16, which operates to selectively establish a bend angle in the drill string at a point 17, is described and claimed in U.S. patent application Ser. No. 649,107, filed concurrently herewith in the name of Warren E. Askew and assigned to the assignee of this invention. The disclosure of this application is incorporated herein by reference. The bend angle$\Theta$ is shown as an angle$\Theta$ in FIG. 1. A means 18 for measuring the inclination and azimuth of the drill string below the point 17 is connected between the mechanism 16 and a near-bit stabilizer 19 which is located in the drill string immediately above a rotary rock bit 20. The bit 20 is turned by the motor 15 via a drive shaft that extends through the tools 17 and 18 to a spindle that is mounted in a bearing assembly which can be housed in the near-bit stabilizer 19, and which is more fully disclosed and claimed in U.S. patent application Ser. No. 649,777, also filed concurrently herewith in the names of Warren E. Askew and Alan M. Eddison and assigned to the assignee of this invention. The disclosure of the application also is incorporated herein by reference.

Figure 2:
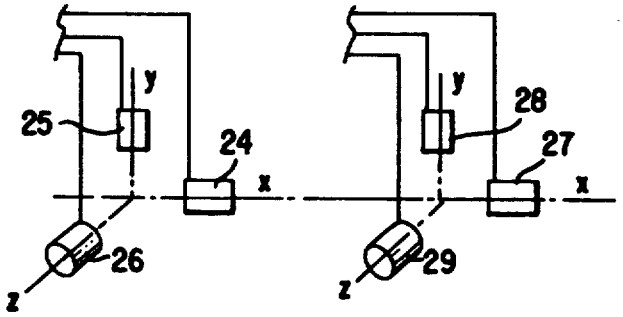
FIG. 2 is a schematic of a directional package for monitoring the inclination and azimuth of a borehole.

To provide accurate control over the path that is drilled by the bit 20, a combination of sensors is used in the sub 18 as shown schematically in FIG. 2. To obtain the inclination of the lower portion of the borehole with respect to the vertical, three accelerometers 24–26 are mounted on orthogonal axes x, y and z so as to measure right angle components of the earth's gravity field. With these measurements, a complete definition of the inclination angle of the borehole 10 can be obtained. To measure the azimuth of such inclination with respect to magnetic North, three magnetometers 27–29 also are mounted on orthogonal axes to measure right angle components of the earth's magnetic field in the region of the well. From these two sets of measurements, a complete definition of the direction of the borehole can be obtained. Although a tri-axial arrangement of sensors 24–29 is illustrated, a bi-axial arrangement can be used. The sensor package is housed in the wall of the sub 18 near the bit 20 so as to measure the directional values applicable to that part of the drill string between the point 17 and the bottom of the hole. The respective outputs of the sensors 24–29 can be coupled by suitable means (not shown) to the system 13 for transmission to the surface as drilling proceeds.

Figure 3:
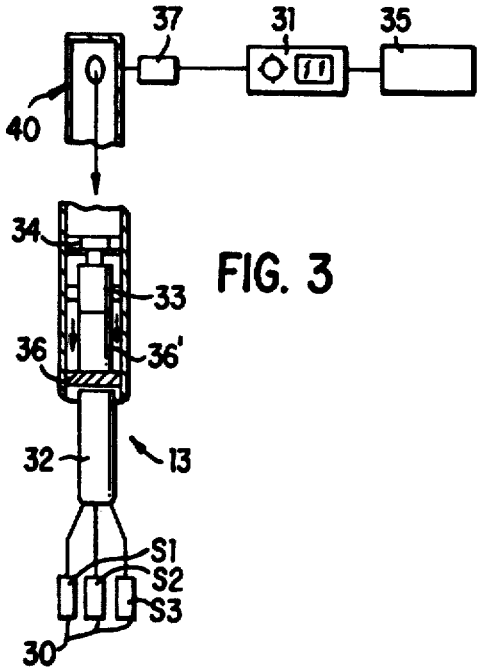
FIG. 3 is a schematic representation of components of a measuring-while-drilling system.

To obtain intelligible information at the surface that is representative of these and other downhole measurements, the system 13 includes components shown schematically in FIG. 3. The drilling mud that is circulated by surface pumps down the drill string passes through a siren-type valve 34 that repeatedly interrupts the mud flow to produce a stream of pressure pulses that can be detected by suitable pressure transducers 37 at the surface. After the mud passes through the rotary valve 34, it flows through a turbine 36 which operates a generator that provides electrical power for the system. The rate of rotation of the valve 34 is modulated by a controller 33 in response to a train of signals from an electronic cartridge 32, with measurement data from various ones of the sensors 30 forming discrete portions of the control train of signals. Thus the pressure pulses that are received at the surface during a certain time period after a timing signal is received is directly related to the magnitude of a particular downhole measurement. Those pulses that are representative of the directional measurements are detected and then analyzed on a continuous basis by machine computation at 31 to determine inclination and azimuth, which is displayed to an operator and recorded at 35. The foregoing telemetry technology is generally known at least in its broader concepts, and needs no further elaboration herein. Other types of mud pulse telemetry systems, such as positive pulse, negative pulse, or combinations thereof may also be used.

The system 13 includes its own direction sensor package like that shown in FIG. 2, so that directional measurements preferably are made both above and below the bend point 17. Substantially in real time, the operator is informed of the current direction of the lower portion of the borehole. For example, the lower section of the borehole may have an inclination of 30° off vertical, and the azimuth of such inclination may be S 45°W. From measurement and plotting of such data at regular depth intervals, a map of the borehole can be created which shows precisely where the bottom of the hole is at any point in time, as well as where the drill bit 20 is headed. Of course most wells are drilled to a predetermined target location at which the well is to be bottomed out, and adjustments are made along the way to ensure that the hole bottom is as close as possible to such target.

Where an adjustment in hole direction needs to be made, the bent housing mechanism 16 is operated to create a bend angle in the drill string below the motor 15. The normal condition of the mechanism 16 is for straight-ahead drilling where the axial centerlines of its housing, the motor 15 and the bit 20 are substantially aligned. The mechanism 16 can be adjusted downhole to provide an approriate bend angle$\Theta$, such as 1°, although other angles can be obtained depending upon tool geometry, by manipulating its mandrel with respect to its housing as will be disclosed in further detail herebelow. With a bend angle provided in this tool, the bit 20 tends to drill along a curved path that lies in a plane which contains the two axes of the bend angle$\Theta$ and the bend point 17. Straight-ahead drilling can be resumed at any time by adjusting the mechanism 16 downhole to eliminate the bend angle. Of course it is possible to rotate the drill string so that the bend point 17 orbits about the longitudinal axis of the borehole to achieve straight ahead drilling. However it is preferable to adjust the mechanism back to its normally straight condition to eliminate cyclical stresses and vibrations. If the bend point 17 is adjacent the high side of the hole 10, the bit 20 will tend to drill on a downward curving path. If the two-bend-point 17 is adjacent the low side of the hole, the bit 20 will build angle and drill along an upwardly curving path. Curves to the right or left can be drilled by appropriate orientation of the plane containing the two axes of the angle$\Theta$ and the point 17.

The near-bit stabilizer 19 also adjusts between one condition where its wall-engaging members 34 are full-gage, and another condition where the members are retracted so that the bend angle created by the mechanism 16 will not cause high lateral forces on the bit which can cause the motor to stall. Normally, the members 34 are retracted so that the assembly is slightly undergage and only during drill string rotation are the members full gage.

Figure 4:
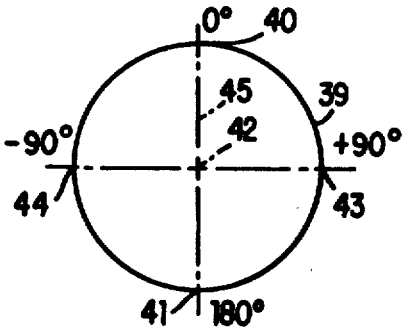
FIG. 4 is a representation of a tool face display.

A surface display that is particularly useful in connection with directional control is the "tool face" of the bit 20. As shown in FIG. 4 a circle 39 centered at 42 is a view looking down at the bit 20 in the lower portion of the borehole 10. The upwardly extending y axis 45 intersects the circle at a point 40 designated as 0°, and this same axis intersects the bottom of the circle at a point 41 denoted as plus or minus 180°. The axis 42 extended to the right intersects the circle 39 at point 43 designated as plus 90°, and this axis extended to the left crosses the circle at a point 44 designated as minus 90°. For example if there is a bend angle established by the mechanism 16 and the tool face reading is near 0°, then the bit is drilling along a path that is curving upward and thus building angle. If the reading is around 180°, the path is curving downward, and the inclination angle is dropping; plus 90° indicates that the borehole is proceeding to the right, and minus 90° to the left. Of course the reading can be anywhere around the circle 39, depending upon azimuth. This display is generated at the surface using the directional data being transmitted uphole by the system 18 as the drilling proceeds, and aids in establishing close control over the path taken by the borehole 21. The tool face reading also is useful in instituting course corrections as needed.

Figure 5:
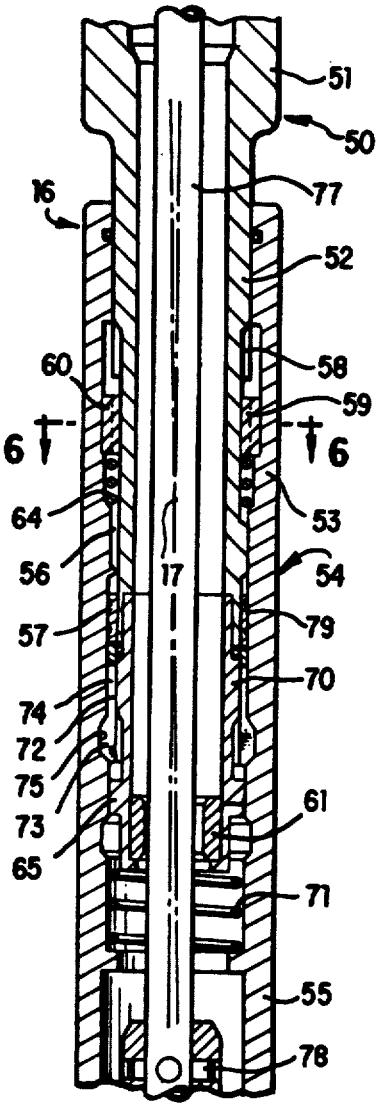
FIG. 5 is a sectional view of a downhole adjustable bent housing assembly that is used in the present invention.

As shown in FIG. 5, the bent housing mechanism 16 includes a mandrel 50 having an upper portion 51 and a lower portion 52 that is slightly inclined with respect to the upper portion. The lower portion 52 is received in the bore of the upper section 53 of a tubular housing 54, such bore also being inclined downward and outward with respect to the centerline of the lower section 55 of the housing. The centerline of the lower housing section 55 normally lines up with the centerline of the upper mandrel portion 51, so that overall the assembly is substantially straight. The mandrel portion 51 can telescope a limited amount within the housing section 53 and also can rotate a limited amount therein. Normally, the mandrel 50 is extended with respect to the housing 54 and is rotationally coupled in this position by a releasable clutch in the form of mandrel splines 56 and housing grooves 57.

Figure 6:
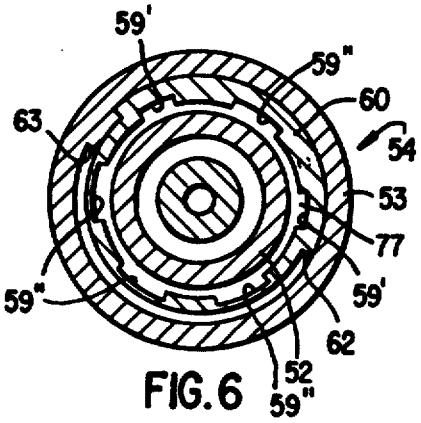
FIG. 6 is a cross-section on line 6—6 of FIG. 5.

To create a bend angle, the mandrel portion 52 is moved downward into the housing section 53 to disengage the splines 56 from the grooves 57 and to engage a set of upper splines 58 with internal grooves 59 in a stop ring 60. The grooves 59 preferably have different widths, for example narrower grooves 59' 59' and wider grooves 59" as shown in FIG. 6. The splines 58 on the mandrel 50 have the same arrangement of widths so that they will fit into the grooves in only one relative orientation. After engagement in response to downward movement, the mandrel and stop ring 60 are rotated through an angle of 180° relative to the housing 54, where a stop shoulder 62 on the ring 60 abuts an inwardly extending shoulder 63 on the housing to stop the rotation. During such relative rotation, the housing 54 becomes inclined with respect to the axis of the upper portion 51 of the mandrel 50 by a certain bend angle that typically lies in the range of from ½° to about 3°, depending upon tool geometry as noted above. Then the mandrel 50 is raised relative to the housing 54 to withdraw the upper splines 58 from the internal grooves 59 in stop ring 60 and to reengage the clutch splines 56, 57. A torsion spring 64 having tangs at its upper and lower ends that engage respectively the stop ring 60 and the housing 54 causes the stop ring 60 to automatically turn back to its initial position when the mandrel splines 58 are withdrawn. The bend angle created in the assembly 16 at an axis crossing point 17 causes the bit 20 to drill along a curve that lies in a plane which contains the two axes of the bend angle. By using the same sequence of surface manipulations of the pipe string, the axes of the upper mandrel portion 51 and the lower housing section 55 can be realigned as the members are returned to their initial reference position so that the bit 20 returns to a mode where it drills straight ahead.

To lock the mandrel 50 in the extended position during drilling, a locking sleeve 70 that is biased upward by a coil spring 71 carries an orifice member 61 that sees a pressure drop when mud circulation is initiated. The resulting force shifts the sleeve 70 downward to position a locking surface 72 behind the heads 73 of a plurality of spring fingers 74 which are attached to the lower end of the mandrel 50. This locks the heads in an internal recess 75 in the housing. The orifice member 51 and the sleeve 70 preferably are keyed against rotation relative to the housing 54 by any suitable means such as a pin that extends into the side of the member 51, and a key on a spider that engages a longitudinal slot in the housing 59. The drive shaft 77 that extends from the power section of the downhole motor 15 to a bearing assembly that is housed by the near bit stabilizer 19 extends through the internal bores of the mandrel 50 and the housing 54, the shaft being coupled by universal joints (lower joint 78 shown). The centerline of the throat of the orifice member 51 is offset as shown to accommodate the rotation axis of the shaft 77. When a bend angle is established by pivotal rotation of the housing 54 about the point 17, the shaft 77 rotates on the other side of the throat of the member 51. In both positions, rotating clearance is provided.

A floating piston 79 that is located between the respective lower end portions of the mandrel 50 and the housing 54 compensates a lubricating oil contained in the chamber thereabove for changes in temperature and pressure. The way the bend angle is established also can be recognized by assuming that the housing 54 remains stationary as the mandrel 50 is rotated 180°. The axial centerline of the upper portion 51 of the mandrel 50 will pivot about point 17 through a conical arc, and its centerline will shift over through an angle that is twice the angle between the centerline of its lower portion 52 and the axial centerline of its upper portion 51. Thus if this angle is ½°, then the bend angle will be 1°. In reality, both axes pivot to some extent in the well bore as the bend angle is established between the motor 15 and the bit 20.

Figure 7:
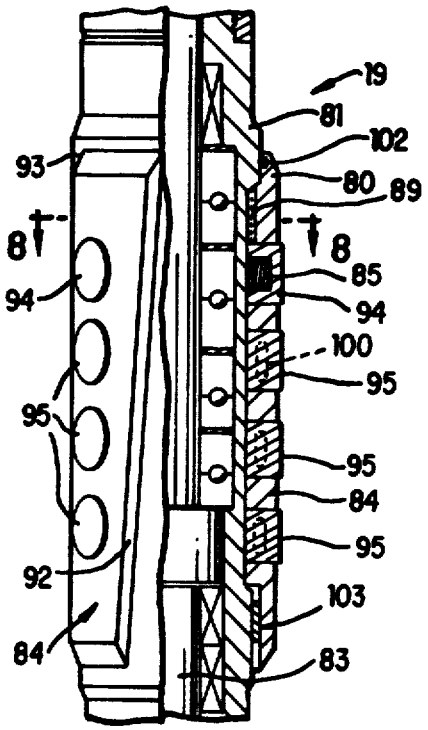
FIG. 7 is a view similar to FIG. 5 of a downhole adjustable near-bit stabilizer.
Figure 8:
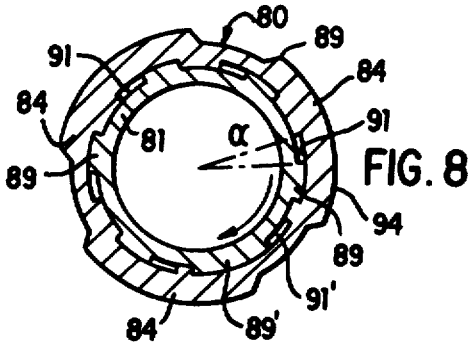
FIG. 8 is a cross-section on line 8—8 of FIG. 7.
Figure 9:
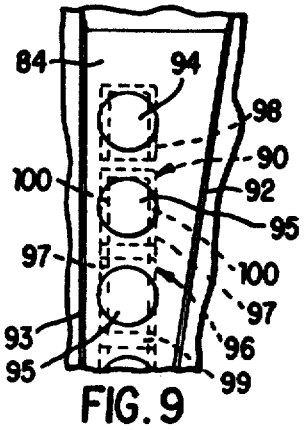
FIG. 9 is a fragmentary, developed, external plan view of a blade and button assembly used in the stabilizer shown in FIG. 7.

The adjustable near-bit stabilizer 19 is shown in FIGS. 7-9 and includes a housing 80 that can rotate by a limited amount on a mandrel 81. The mandrel 81 can be arranged internally as shown to house the radial and thrust bearings for the downhole motor and through which the bit shaft 83 rotates. The housing 80 preferably has three external blades 84 whose outer surfaces are on a diameter that is slightly undergage with respect to the outer diameter of the bit 20, and a set of four wall-engaging buttons is mounted in longitudinally spaced, radial bores in each blade. The upper ones of the buttons 94 are biased outward by springs 85 to provide a frictional drag effect through engagement with the wall of the borehole. The lower ones 95 of the buttons are movable between retracted, undergage positions where their outer faces are flush with the outer faces of the blades 84, and extended, full-gage positions. The outer faces of the blades 84 and the buttons 94, 95 are preferably wear-hardened. Suitable stops are provided to limit outward movement, and the lower buttons 95 are each biased inward by a leaf spring or the like. These elements are best seen in phantom lines in FIG. 9 where an inverted U-shaped bracket 96 has depending legs 97 that fit into grooves 100 milled in the opposite sides of the buttons 95. As shown in dotted lines in FIG. 7 the bracket 96 causes the buttons 95 to move in unison, and all three buttons are stopped against outward movement when the bracket engages internal surfaces of the housing 80. The upper buttons 94 are retained by U-shaped members 98 that also engage side slots as shown. Means such as leaf springs 99 which can be fastened between the legs 97 have convex center portions which engage inner walls of the housing between the bores in order to bias the brackets 90, and thus the buttons 90, inward.

The housing 80 is sealed with respect to the mandrel 81 by a seal 102 at the top, and each button 94, 95 carries a seal ring (not shown) that engages the wall of the bore in which it is positioned. These seals enclose an internal cavity which contains lubricating oil, the oil being compensated for changes in temperature and hydrostatic pressure by a floating piston 103 that is located in an annular area between the mandrel 81 and the lower end of the housing 80.

Figure 10:
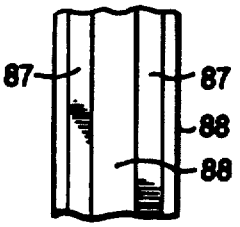
FIG. 10 is a fragmentary external view of the mandrel included in the stabilizer of FIG. 7.

The radial positions of the buttons 95 are controlled by the shape of the outer peripheral surface of the mandrel 81, which as shown in FIG. 10 has longitudinal cam flats 87 that are centered on 120° spacings. The flats 87 can be radially aligned with the backs of the buttons 95 to enable their retraction, or the full o.d. surfaces 88 on the mandrel can be aligned with the buttons to cause them to extend. The flats 87 are joined to the o.d. surfaces 88 by smoothly rounded transition surfaces. When extended, the buttons 95 provide a full gage stabilizing action for the bit 20 to keep it in the center of the borehole. When the flats 87 are behind the buttons 95, they shift inward to an undergage diameter where the stabilizer 19 can tilt somewhat in the borehole. This feature allows the bend angle created by the mechanism 16 to be fully effective in controlling the path drilled by the bit 20, and prevents large side forces from being applied to the bit which could otherwise cause the motor to stall out.

Rotation of the housing 80 relative to the mandrel 81 is limited by splines 89 that engage in housing grooves 91 which are wider than the splines as shown in FIG. 8, so that relative rotation is permitted through an angle Θ. Hereagain one of the splines 89' and one groove 91' preferably are wider than the others so that the splines will mesh in only one rotational position. As viewed from above, the left-hand edge 92 of each blade 84 is inclined on a helix that extends clockwise and downward. The right hand edge 93 of each blade 84 is straight. Thus when the stabilizer slides downward in the borehole, lateral pressure is applied to the helical edge of a blade to cause the housing 80 to rotate clockwise by an amount limited by engagement of the side walls of the grooves 91 with the splines 89. In this position the buttons 95 are opposite the flats 87 and thus retracted. However, if the drill string is rotated, the housing 80 moves counterclockwise relative to the mandrel to extend the buttons 95.

The near-bit directional sensor package 18 includes a tubular member that preferably is made of substantially non-magnetic metal that is connected between the lower end of the bent housing assembly 16 and the upper end of the adjustable stabilizer 19. A cavity (not shown) in the wall of the sub 18 houses the combination of sensors shown in FIG. 2 which measure components of the earth's gravity and magnetic fields. As previously described, the combination includes accelerometers and magnetometers that are mounted on orthogonal axes, preferably tri-axial. These devices provide outputs from which the inclination and azimuth of that part of the drill string between the bend angle point 17 and the bit 20 can be computed. When compared to the directional information provided by the measuring-whiledrilling system 13 which is located above the motor 15, other important information can be gained. For example, a difference between the inclination angles provides confirmation that a predetermined bend angle has in fact been achieved by operation of the bent housing assembly 16. The roll angle of the plane of the bend with respect to vertical, which indicates tool face, can be precisely determined in advance to ensure that the bit path will proceed along a selected course, and can be continuously monitored.

The measurements made by the sensors in the sub 18 can be cued up in a train of other measurements made by the tool 13, whereby pressure pulses generated by the rotary valve 34 (or other type of mud pulse telemetry system) during a certain time frame are representative of these measurements.

OPERATION

The bottom hole assembly of equipment components as disclosed herein is operated in the following manner. Drilling mud that is pumped down the drill string powers the system 13 to provide telemetering, rotates the mud motor 15 to turn the bit 20, and creates a pressure drop across the orifice member 61 in the bent housing tool 16 which locks the mandrel 50 in the extended position with its parts in the relative positions shown in FIG. 5. Where the assembly 16 is in its straight condition and where pipe rotation is superimposed over that of the motor 15, the stabilizer 19 will be full gage so that drilling will proceed straight ahead at whatever inclination and azimuth have already been established. The buttons 95 of the stabilizer 19 are opposite the outer surfaces 88 and thus are extended. When the bent assembly 16 is operated to establish a bend angle Θ at the point 17, the pipe is not rotated so that further drilling is done in response to rotation of the motor 15. The drill pipe merely slides down the hole as the bit 20 makes progress. In response to downward sliding the stabilizer 19 assumes its undergage diameter to enable the bit 20 to drill along a curved path in a predictable manner. Any time the pipe is rotated, regardless of the condition of the bend assembly 16, the stabilizer 19 adjusts to its full gage diameter.

The sensor package 18 monitors inclination and azimuth, as do the direction sensors in the system 13 above the motor 15. The values sensed by these two vertically spaced packages can be compared, and of course should substantially agree when the bend assembly 16 is straight. When the borehole 10 is inclined, the stabilizers 19 and 14 and the bit 20 provide three longitudinally spaced points of engagement with the low side of the borehole wall that define the curvature of the borehole.

These points of contact A, B, and C are illustrated in FIG. 1. The bend point 17 is located between points A and B. It can be demonstrated that the radius of borehole curvature is directly related to the sum of the respective tangent lengths between points C and B and B and A, and inversely related to the sine of the angle between a line drawn through points C and B and a line drawn through points B and A. The results of this analysis can be compared using measurements made by the sensors in sub 18 and in the system 13, which are read out at the surface during drilling. Any needed adjustments or corrections can be made as the occasion arises. Boreholes can be drilled having a long radius of curvature where the inclination is changed about 3°-5° per 100 feet of hole, a medium radius where inclination is changed by about 10° per 100 feet, and short radius where the inclination is changed by 15° and up per 100 feet. All such curvatures can be made with very accurate control over the directional drilling process through practive of the present invention.

To operate the bent assembly 15, mud circulation is stopped temporarily to unlock the bent housing 17 as the locking sleeve 70 is shifted upward by the spring 71. Then the drill string is lowered to telescope the mandrel 50 down inside the housing 54 to engage the splines 58 with the stop ring 60 and to disengage the clutch splines 56, 57. The drill string then is turned to the right several turns to ensure that the stop ring 60 is rotated 180° to where its stop shoulder 62 is in engagement with the housing shoulder 63. During such rotation, the spring-loaded buttons 94 on the stabilizer 19 resist rotation of the housing 54. The central axis of the lower housing section 55 may be considered as swinging through a conical arc about the bend point 17, and becomes inclined with respect to the central axis of the upper mandrel section 51 by a bend angle of 1°, for example. The mandrel 50 then is raised by the drill string to reengage the clutch splines 56, 57 and to withdraw the upper mandrel splines 58 from the grooves in the stop ring 60. The torsion spring 64 automatically rotates the stop ring 60 back to its original orientation, in readiness for a subsequent adjustment. When mud circulation is restarted, the locking sleeve 70 shifts down and locks the heads 73 in the housing recess 75.

The near-bit sensor package 18 now will monitor directional parameters below the bend point 17, so that a surface display is made to confirm that the bent housing has operated, particularly when compared with the information given by the directional sensors in the tool 13 which is located above the bend point. The bend angle Θ causes the bit 20 to drill along a curved path, and the curved path will lie in the plane below the point 17 that contains the two axes of the bend angle Θ, and the point 17. The roll angle of the plane with respect to vertical can be monitored at the surface for accurate control over hole direction.

If necessary, rotation of the drill string at the surface can be superimposed on the rotation of the motor 15 to cause the bit 20 to temporarily drill straight ahead, even though a bend angle Θ is present in the mechanism 16. During such rotation the bend point 17 merely orbits about the axis of the borehole, and the bit 20, although it wobbles somewhat, tends to drill straight. When drill string rotation is superimposed, the housing 80 of the stabilizer 19 is rotated a limited amount counter-clockwise, as viewed from above, which causes extension of the buttons 86 to their full gage diameter. However straight ahead drilling by readjustment of the mechanism 16 to remove the bend angle is greatly preferred because of the above-mentioned problems that are created when the drill string is rotated. The bend angle can be removed at any time in response to the same surface manipulations of the pipe described above, to cause drilling to proceed straight ahead. Where the assembly 15 is straight and the pipe string is rotated, the near-bit stabilizer automatically adjusts to its full gage condition, so that essentially there is a packed-hole stabilization 19 system.

It now will be recognized that new and improved methods and apparatus for controlling the direction of drilling have been disclosed. Since certain changes or modifications may be made in the disclosed embodiments without departing from the inventive concepts involved, it is the aim of the following claims to cover all changes and modifications falling within the true spirit and scope of the present invention.

What is claimed is:

1. A method of controlling the direction of a borehole being drilled by a drill string that includes a downhole motor assembly that turns a drill bit, comprising the steps of: providing an adjustable bent housing in a lower portion of said motor assembly that in one position aligns the rotation axis of the bit with the longitudinal axis of the motor assembly, and in another position produces a bend angle at a bend point in said bent housing that causes the bit to drill along a curved path; providing a near-bit stabilizer between the bent housing and the bit that has a full gage condition and an undergage condition; adjusting the position of said bent housing to provide a bend angle therein at said bend point; and changing said stabilizer to said undergage condition so that during further drilling said bend angle is fully effective in altering the inclination of the borehole.

2. The method of claim 1 including the further step of rotating the drill string to cause said stabilizer to change to its full gage condition.

3. The method of claim 1 including the further steps of measuring the direction of the borehole at a location near said bit, and telemetering the results of such measuring to the surface during drilling.

4. The method of claim 3 including the further steps of measuring the direction of the borehole at a location above said downhole motor assembly, and telemetering the results of such measuring to the surface while drilling.

5. The method of claim 3 or claim 4 wherein said measuring step includes sensing the inclination of the borehole and the azimuth of such inclination.

6. The method of claim 5 including the further step of using said inclination and said azimuth measurements to orient a plane containing the two axes of said bend angle and said bend point at a selected angle with respect to the vertical.

7. A method of controlling the direction of a borehole that is being drilled with a downhole motor assembly and a rock bit at the lower end of a drill string, comprising the steps of: using surface manipulations of said drill string to produce downhole a bend angle in said assembly between upper and lower portions thereof, said bend angle being defined between the respective longitudinal axes of said upper and lower portions, said axes crossing one another at a said bend point and lying in a common plane below said bend point; measuring and telemetering to the surface signals representative of the angular orientation of said plane with respect to a frame of reference; and orienting said plane to achieve a desired borehole direction during further drilling.

8. The method of claim 7 wherein said measuring step includes measuring the respective inclinations of a portion of the drill that is immediately above said motor assembly and the said longitudinal axis defined by said lower portion of said motor assembly below said bend point, and comparing the values of such inclination measurements to confirm the production of said bend angle.

9. The method of claim 8 wherein said inclination measuring step for the portion of the drill string that is above said motor assembly is carried out using a first sensor package located in the drill string above said motor assembly, and said inclination measuring step for that portion of said motor assembly which is located below said bend point is carried out using a second sensor package that is located below said bend point and near said bit.

10. The method of claim 7 including the further step of stabilizing said drill string and said bit in the borehole using a stabilizer that is located immediately above the bit, said stabilizer being adjustable downhole between an undergage condition and a full gage condition.

11. The method of claim 7 including the step of holding the drill string stationary at the surface to allow said bend angle and the angular orientation of said plane to cause said bit to drill along a curved path in said plane.

12. The method of claim 7 including the step of continuously rotating the drill string at the surface to cause said bend point to orbit about the axis of the borehole and said bit to drill a straight path in said plane.

13. The method of claim 7 including the further steps of turning the drill string at the surface to angularly orient said plane in a selected position with respect to the vertical, and operating said motor angularly to cause said bit to drill along a curved path that lies in said plane.

14. A method of controlling the direction of a borehole being drilled by a downhole motor assembly that drives a drill bit, comprising the steps of: providing a bent housing mechanism in the lower portion of said motor assembly that has two positions, one of said positions being for straight-ahead drilling and the other of said positions providing a bend point that causes curved drilling; making measurements of the inclination of the borehole below said bend point; telemetering said measurements to the surface on a substantially continuous basis; and adjusting the position of said bent housing mechanism to perform one of said straight-ahead and curved drilling in accordance with said measurements.

15. The method of claim 14 including the further steps of making measurements of the azimuth of such inclination; and telemetering said azimuth measurements to the surface along with said inclination measurements.

16. The method of claim 14 including the further steps of providing other measurements of inclination of said borehole above said motor assembly; and telemetering said other measurements to the surface for comparison with said firstmentioned inclination measurements to determine the position of said bent housing mechanism.

17. The method of claim 14 including the further steps of providing stabilizer means near said bit having full gage and undergage conditions and; placing said stabilizer in said undergage condition while said curved drilling is being carried out.

18. The method of claim 17 including the further step of placing said stabilizer in said full gage condition while straight-ahead drilling is being carried out.

19. The method of claim 14 including the further steps of using said inclination measurements when said bent mechanism is adjusted for said curved drilling to orient the plane containing the axes of said bend angle and said bend point with respect to vertical in such a manner that the curvature of the borehole will extend toward the right or to the left of its previous path.

20. The method of claim 14 including the further steps of measuring and telemetering to the surface the azimuth of said inclination; and determining the tool face angle of said bit from said measurements.

21. A method of controlling the inclination of a borehole being drilled with a downhole motor assembly and a bit suspended in the borehole on a drill string, comprising the steps of: positioning a retractable stabilizer and a downhole adjustable bent housing in a drill string, said stabilizer being positioned near said bit and having a full gage condition and an undergage condition, said bent housing forming a lower portion of said motor assembly and being positioned above said stabilizer; operating said bent housing to establish a bend angle at a bend point therein; placing said stabilizer in said undergage condition to allow said bend angle to be fully effective in changing the path drilled by said bit; and operating said motor assembly to cause said bit to drill along a curved path.

22. The method of claim 21 including the further steps of: rotating said drill string at the surface while continuing to operate said motor assembly to cause said bit to drill straight ahead; and placing said stabilizer in said full gage condition during rotation of said drill string.

23. A method of controlling the direction of a borehole being drilled by a downhole motor assembly that includes a power section which rotates a drill bit on the lower end of a drill string, comprising the steps of: providing a bent housing between said power section of said motor assembly and the drill bit that in one position aligns the rotation axis of the bit with the longitudinal axis of said power section, and in another position produces a bend angle at a bend point therein that causes the bit to drill along a curved path; providing a near-bit stabilizer between the bent housing and the bit that has a full gage condition and an undergage condition; adjusting the position of the bent housing to provide said other position; operating said power section of said motor to rotate said bit and deepen the borehole, said drill string sliding downward in the borehole as deepening occurs; and placing said stabilizer in said undergage condition during such downward sliding to cause the inclination angle of the borehole to drop at a low rate as drilling proceeds.

24. A combination of apparatus for use in controlling the direction of a borehole being drilled by a downhole motor assembly that turns a drill bit on the lower end of a drill string in response to mud circulation, comprising: a downhole adjustable bent housing mechanism forming a lower portion of said motor assembly, said mechanism being adjustable between straight and bent conditions with respect to a bend point therein; near-bit stabilizer means between said bent housing mechanism and said bit, said stabilizer means including laterally shiftable wall-engaging means having undergage and full gage conditions; and means for positioning said wall-engaging members in said undergage condition when drilling is being done with said bent housing mechanism adjusted to its bent condition.

25. The combination of claim 24 further including additional stabilizer means above said motor assembly, said additional stabilizer means, said near-bit stabilizer means and said bit providing three longitudinally spaced points of contact with the borehole walls which define the curvature of a borehole in a lower section thereof.

26. The combination of claim 24 wherein said bent housing mechanism includes a mandrel telescopically disposed in a housing and rotatable between a first position and a second position relative thereto, said mandrel and said housing each having a pair of longitudinal axes that are inclined relative to one another, releasable clutch means for preventing relative rotation in said first position to maintain said mandrel and said housing in said straight position; and stop means for limiting relative rotation in said second position where one of said axes of said mandrel and one of said axes of said housing are inclined relative to one another to provide a bend angle in said mechanism.

27. The combination of claim 26 further including drag means providing a frictional restraint against rotation of said housing in a well bore.

28. The combination of claim 26 further including means for locking said mandrel and housing against telescopic movement during circulation of drilling mud therethrough.

29. The combination of claim 24 wherein said near-bit stabilizer includes a mandrel having a housing carried thereon, said housing having a plurality of circumferentially spaced blades, each of said blades having a vertical series of radially arranged bores therein, said wall-engaging members extending through said radial bores; and means on said mandrel for shifting said members outward in response to rotation of said housing relative to said mandrel in one rotational direction and for enabling retraction of said members in response to rotation of said housing relative to said mandrel in the opposite rotational direction.

30. The combination of claim 29 wherein said shifting means includes cam surfaces on said mandrel adjacent said members.

31. The combination of claim 30 wherein said shifting means further includes helical surfaces on one side of each of said blades adapted to frictionally engage the well bore wall and cause said housing to rotate relative to said mandrel in said opposite rotational direction during downward movement in a borehole.

32. The combination of claim 24 further including first direction sensor means between said bent housing mechanism and said bit for measuring inclination and azimuth of the borehole below said bend point.

33. The combination of claim 32 further including second direction sensor means above said motor assembly for measuring inclination and azimuth of the borehole above said motor assembly; and telemetry means for transmitting to the surface signals that are representative of the measurements made by said first and second direction sensor means.

34. The apparatus of claim 24 further including additional stabilizer means in the drill string above said motor assembly, said additional stabilizer means having laterally shiftable members that are movable between undergage and full gage positions; and means responsive to manipulation of the drill string at the surface for selectively shifting said members between said positions.

* * * * *